US005555924A

United States Patent [19]

Iwamoto et al.

[11] Patent Number: 5,555,924

[45] Date of Patent: Sep. 17, 1996

[54] SQUEEZE PIN CONTROL METHOD AND APPARATUS FOR DIE CASTING MACHINE

[75] Inventors: Norihiro Iwamoto, Sagamihara; Masayuki Takamura, Zama; Tai Matsuda, Kawasaki, all of Japan

[73] Assignee: Toshiba Kikai Kabushiki Kaisha, Tokyo-To, Japan

[21] Appl. No.: 328,839

[22] Filed: Oct. 25, 1994

[30] Foreign Application Priority Data

Oct. 26, 1993 [JP] Japan ..... 5-267415
Sep. 8, 1994 [JP] Japan ..... 6-240550

[51] Int. Cl.[6] ..... B22D 18/02; B22D 27/11

[52] U.S. Cl. ..... 164/4.1; 164/120; 164/319; 164/154.2

[58] Field of Search ..... 164/4.1, 457, 120, 164/319, 320, 151.2, 155.4, 154.2

[56] References Cited

U.S. PATENT DOCUMENTS 4,844,146 7/1989 Kikuchi ..... 164/120
5,161,598 11/1992 Iwamoto et al. ..... 164/120

FOREIGN PATENT DOCUMENTS 4-118167 4/1992 Japan .

*Primary Examiner*—Kuang Y. Lin
*Attorney, Agent, or Firm*—Fish & Richardson P.C.

[57] ABSTRACT

A stroke S of a squeeze pin under no load condition of a squeeze pin cylinder for driving the squeeze pin is detected. A value (S–α) obtained by subtracting a small value α from the detected stroke S of the squeeze pin is determined as a set stroke of the squeeze pin. After a predetermined waiting time has elapsed from when melted metal is charged into a cavity completely, the squeeze pin is advanced. Here, the actual stroke Sf of the squeeze pin is detected, and the detected stroke Sf is compared with set stroke (S–α±β), where β is an allowable deflection. As the result of comparison, if Sf oversteps the set limits (S–α±β), at least one of parameters (the pressure and the flow rate of hydraulic fluid supplied to the squeeze pin cylinder and the waiting time) is corrected, so that the detected stroke value Sf approaches the set stroke (S–α) for the succeeding casting cycle.

9 Claims, 4 Drawing Sheets

SQUEEZE PIN CONTROL METHOD AND APPARATUS FOR DIE CASTING MACHINE

BACKGROUND OF THE INVENTION

1. Field of the Invention

The present invention relates to a method and an apparatus for controlling a squeeze pin used for pressurizing melted metal charged into a cavity of a metal mold in a die casting machine.

2. Description of the Prior Art

In general die casting, whenever melted metal is solidified in a cavity of a metal mold, there exists such a tendency that shrinkage porosities are easily produced in casted products due to shrinkage of volume of the casted products. The shrinkage porosities of course deteriorate the quality (e.g., strength) of the casted products. To overcome this problem, therefore, a method of preventing shrinkage porosities from being produced with a squeeze pin has been so far adopted, in which the squeeze pin is pushed into melted metal in the cavity of the metal mold to locally pressurize the melted metal.

In this pressurizing method by use of the squeeze pin, it is indispensable to decide an appropriate pressure and an appropriate pressurization timing according to various casting conditions. An example of method of controlling this squeeze pin is disclosed in Japanese Published Unexamined (Kokai) Patent Application No. 4-118167, for instance. In this prior art squeeze pin control method, the melted metal is pressurized under appropriate conditions by detecting the stroke of the squeeze pin, and by controlling the timing at which the squeeze pin is pushed into the cavity so that the detected stroke of the pin can be set to a predetermined value.

In this prior art control method, however, it is necessary to previously determine the optimal stroke of the squeeze pin for each pin, according to the metal mold and the casting conditions. Therefore, in case the stroke of the squeeze pin is set erroneously, there exists a problem in that the squeeze pin is controlled on the basis of an erroneously set value.

Further, when a plurality of squeeze pins are used for one metal mold, since the respective strokes of cylinders for driving the respective squeeze pins differ from each other, it is necessary to determine and control each of the cylinder strokes (i.e., pin strokes) at an optimal value, respectively. In summary, in the prior art method of controlling the squeeze pins, since the strokes of the squeeze pins differ delicately from each other according to the squeeze pins and the casting conditions, there exits a problem in that toilsome and complicated labor has been so far needed for controlling the squeeze pins in the die casting machine.

SUMMARY OF THE INVENTION

With these problems in mind, therefore, it is the object of the present invention to provide a method and apparatus for controlling a squeeze pin or squeeze pins for a die casting machine, which can automatically control the stroke of the squeeze pin at an optimal value, for prevention of shrinkage porosity generation in casted products and for improvement of quality in casted products.

To achieve the above-mentioned object, the present invention provides a method of controlling a squeeze pin in a die casting machine for locally pressurizing melted metal charged into a cavity of a metal mold with at least one squeeze pin, comprising the steps of: detecting a stroke S of the squeeze pin under no load condition of a squeeze pin cylinder for driving the squeeze pin; setting a value ($S-\alpha$) obtained by subtracting a small value a from the detected squeeze pin stroke S as a set stroke of the squeeze pin; advancing the squeeze pin after a predetermined waiting time has been elapsed from when melted metal has been charged into the cavity completely; detecting an actual stroke of the squeeze pin; comparing the detected actual stroke value Sf with set limits ($S-\alpha \pm\beta$, where $\beta$ is an allowable deflection); and if the comparison result is that Sf oversteps the set limits ($S-\alpha\pm\beta$), correcting at least one of parameters of pressure and flow rate of hydraulic fluid supplied to the squeeze pin cylinder and the waiting time so that the detected stroke value Sf approaches the set stroke ($S-\alpha$) in the succeeding casting cycle.

Further, it is preferable that the actual stroke Sf of the squeeze pin is detected after a predetermined pressure application time has elapsed from when the squeeze pin starts to advance. Further, the small value is 2 to 3 mm.

Further, the present invention provides an apparatus for controlling a squeeze pin in a die casting machine for locally pressurizing melted metal charged into a cavity of a metal mold with at least one squeeze pin, comprising: stroke detecting means for detecting an actual stroke S of the squeeze pin; squeeze pin cylinder control means for controlling pressure and flow rate of hydraulic fluid supplied to a squeeze pin cylinder for driving the squeeze pin; stroke correcting means for comparing a detected stroke value Sf of the squeeze pin after a predetermined time has elapsed from when the squeeze pin starts to be advanced by the squeeze pin cylinder, with a set stroke ($S-\alpha$) obtained by subtracting a small value $\alpha$ from a full stroke S of the squeeze pin under no load of the squeeze pin cylinder; and if Sf oversteps set limits ($S-\alpha\pm\beta$, where $\beta$ is an allowable deflection), correcting pressure and/or flow rate of hydraulic fluid supplied to the squeeze pin cylinder and waiting time so that the detected stroke value Sf approaches the set stroke ($S-\alpha$) in the succeeding casting cycle; and control means for controlling the squeeze pin cylinder control means on the basis of the corrected result of said stroke correcting means. Further, it is preferable that when a plurality of squeeze pins are provided, a plurality of squeeze pin cylinders are provided for the squeeze pins, individually; and a plurality of squeeze pin cylinder control means are provided for the squeeze pin cylinders, respectively. Further, the squeeze pin cylinder control means comprises an accumulator, a pressure compensation valve, a proportional electromagnetic relief valve, a proportional electromagnetic direction flow rate control valve, and a check valve. The control means is of digital type including a microprocessor, a ROM, a RAM, and input and output circuits.

Further, the present invention provides a die casting machine for reducing or eliminating shrinkage porosities by pushing a squeeze pin into melted metal prior to solidification by use of a hydraulic cylinder during die casting by use of a metallic mold, which comprises: a hydraulic fluid supply source; a pressure adjusting section for adjusting pressure of hydraulic fluid supplied by said hydraulic fluid supply source; a pressure compensating section for compensating for pressure of the hydraulic fluid whose pressure is adjusted by said pressure adjusting section; a flow rate adjusting section for adjusting flow rate of the hydraulic fluid whose pressure is adjusted by said pressure compensating section; a direction switching valve for switching direction of the hydraulic fluid whose flow rate is adjusted by said flow rate adjusting section; a hydraulic cylinder connected to said direction switching valve to move the squeeze pin; a flow rate counter for counting flow rate of the hydraulic fluid passed through said direction switching valve in a predetermined unit; and a control section for previously obtaining corresponding relationship between flow rate measured by said flow rate counter and position of the squeeze pin and measuring the squeeze pin position indirectly on the basis of the obtained corresponding relationship between both, to control operation stroke and operation time of the hydraulic cylinder and the squeeze pin position indirectly.

It is preferable that the flow rate counter is interposed between the hydraulic cylinder for moving the squeeze pin and said direction switching valve.

In the control method and apparatus according to the present invention, first the stroke S of the squeeze pin is detected under no load condition of the squeeze pin cylinder before melted metal is charged into a cavity. A value ($S-\alpha$) obtained by subtracting a predetermined small value $\alpha$ from the detected squeeze pin stroke S is set as an optimal stroke of the squeeze pin in the present casting cycle. After a predetermined waiting time has elapsed from when melted metal is charged into the cavity completely, the squeeze pin is inserted into the cavity and the actual stroke Sf thereof is detected. The detected actual stroke Sf of the squeeze pin is compared with set limits ($S-\alpha\pm\beta$). If the stroke Sf oversteps the set limits ($S-\alpha\pm\beta$), at least one of the parameters for deciding the actual stroke of the squeeze pin (e.g., the pressure and flow rate of hydraulic fluid supplied to the squeeze pin cylinder and the waiting time between the melted metal charge completion and the squeeze pin insertion) is corrected. In the succeeding casting cycle, the stroke of the squeeze pin is further controlled on the basis of the parameter or parameters now corrected.

As described above, in the control method according to the present invention, since detected stroke value of the squeeze pin is compared with set limits, and at least one of parameters (pressure, flow rate, etc. of the working hydraulic fluid of the squeeze pin cylinder) for deciding the stroke of the squeeze pin is corrected according to the comparison results, it is possible to control the stroke of the squeeze pin at appropriate stroke at all times on the basis of learning effect. As a result, melted metal can be pressurized effectively with the use of the squeeze pin, so that it is possible to prevent shrinkage porosity generation effectively and thereby to improve the quality of casting products markedly.

Further, when the present invention is applied to a die casting machine provided with a plurality of squeeze pins and squeeze pin cylinders, it is possible to automatically determine the optimal strokes of the respective squeeze pins, respectively, without setting the strokes of the squeeze pins previously one by one.

DETAILED DESCRIPTION OF THE PREFERRED EMBODIMENTS

An embodiment of the squeeze pin control method and apparatus according to the present invention will be described hereinbelow with reference to the attached drawings.

Figure 1:
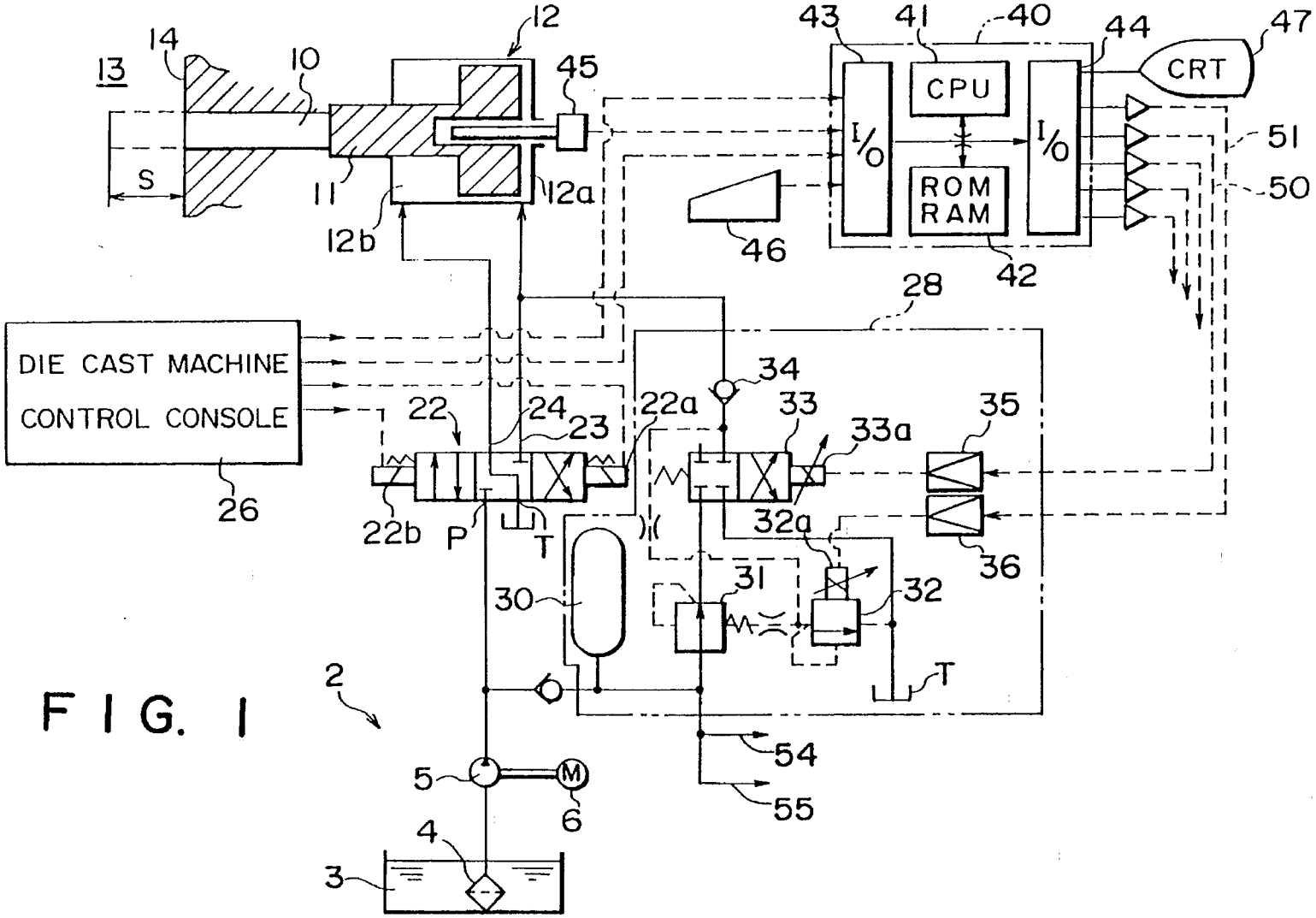
FIG. 1 is a diagrammatical and schematic block diagram showing an embodiment of the squeeze pin control apparatus according to the present invention.
Figure 2:
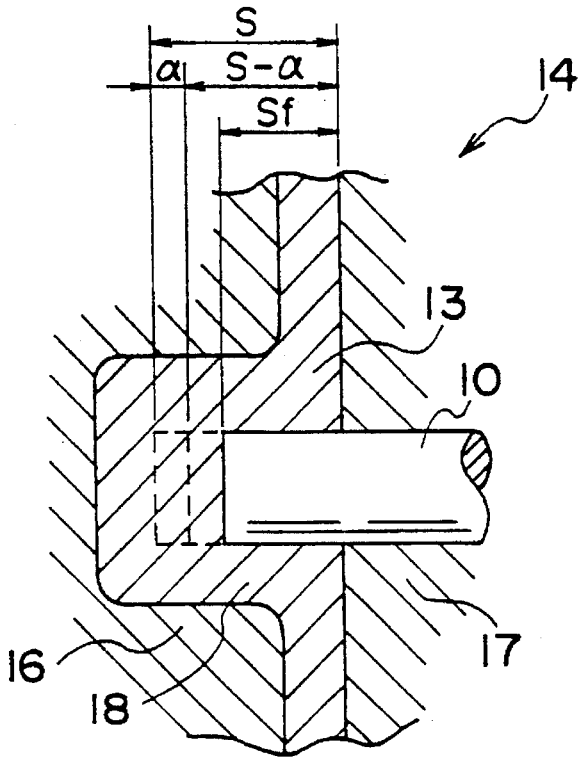
FIG. 2 is a partial cross-sectional view showing a metal mold and a squeeze pin.

FIG. 1 shows a construction of the squeeze pin control apparatus. In the drawing, a squeeze pin 10 is connected to a piston rod 11 of a squeeze pin cylinder 12. When driven by the squeeze pin cylinder 12, the end of the squeeze pin 10 is projected into a cavity 13 through a metal mold 14. As shown in FIG. 2, the metal mold 14 is composed of a fixed mold 16 fixed to a fixed portion of a die casting machine and a movable mold 17 disposed on a movable portion thereof. Further, melted metal 18 is injected into the cavity 13 formed between the fixed mold 16 and the movable mold 17 through an injection sleeve (not shown) under pressurized conditions.

A hydraulic pressure source circuit 2 for supplying hydraulic fluid into the pressurize pin cylinder 12 is used in common with a hydraulic circuit for a core cylinder hydraulic circuit (not shown) of the die casting machine. The hydraulic pressure source circuit 2 is composed of a tank 3, a filter 4, an oil pump 5 and a pumpmotor 6. Hydraulic fluid is introduced into the pressurize pin cylinder 12 from the hydraulic pressure source circuit 2 via an electromagnetic direction control valve 22. At the neutral position, the electromagnetic direction control value 22 is provided with a P port connected to a power line extending from the hydraulic pressure source circuit 2 (as a block position), another port 23 communicating with a head side cylinder chamber **12*a* of the pressurize pin cylinder 12, and a tank port T for communicating a tank port T with an end side cylinder chamber 12*b* of the squeeze pin cylinder 12. Two solenoids 22*a* and 22*b* of the electromagnetic direction control valve 22 are both connected to a control console 26 of the die casting machine. The electromagnetic direction control valve 22 is changed over under control of the control console 26** in linkage with operation of a spray (not shown) for injecting a mold lubricant (mold releasing agent) onto the inner surface of the cavity of the metal mold of the die casting machine.

On the other hand, a squeeze pin cylinder control circuit 28 controls the pressure and the flow rate of the hydraulic fluid supplied to the pressurize pin cylinder 12, which is composed of an accumulator 30, a pressure compensation valve 31, a proportional electromagnetic relief valve 32, a proportional electromagnetic direction flow rate control valve 33, and a check valve 34.

The pressure compensation valve 31 is connected on the downstream side of the accumulator 30, and compensates for fluctuations of load pressure so that the flow rate of the hydraulic fluid introduced from the proportional electromagnetic direction flow rate control valve 33 to the squeeze pin cylinder 12 can be kept constant. In practice, the flow rate of the working fluid supplied to the pressurize pin cylinder 12 can be controlled by adjusting the opening rate of the proportional electromagnetic direction flow rate control valve 33. In the proportional electromagnetic direction flow rate control valve 33, when the solenoid **33*a* is energized, the inlet side pipe communicates with the outlet side pipe, and in addition the opening rate thereof can be controlled according to the intensity of the magnetization of the solenoid 33***a* energized by an opening rate set signal applied by a controller 40 provided with a microprocessor (described later) via an amplifier 35.

On the other hand, the proportional electromagnetic relief valve 32 is provided with a solenoid 32*a* energized on the basis of a pressure setting signal applied by the controller 40 via another amplifier 36, so that the pressure for actuating the pressure cylinder 12 can be determined by the controller 40.

The controller 40 is provided with a central processing unit 41 having a microprocessor CPU, a main storage device 42 having a ROM for storing programs and a RAM for reading and writing data therefrom and therein freely, an input circuit 43 and an output circuit 44. To the central processing unit 41, various elements are connected such as a stroke detector 45 for detecting the stroke of the pressurize pin cylinder 12, the control console 26 of the die casting machine, and a key board 46 for inputting any set data required for the squeeze pin control. That is, as shown in U.S. Pat. 5,161,598, a coil portion is secured to a cylinder head of the pressure pin cylinder. Furthermore, a sleeve-shaped core is included in the piston to cover the coil portion. Therefore, when the piston is moved, the included sleeve core is moved together with it, causing the positional relationship between the coil portion and the sleeve core to be changed. As a result, voltage which corresponds to the position of the piston is transmitted. Since the piston and the pressure pin are integrally connected to each other, the stroke of the pressure pin can be detected by detecting the position of the piston.

When the spray for spraying mold lubricant is actuated at the start of a casting cycle, a spray actuation signal is inputted from the control console 26 to the controller 40. Further, when the cavity of the metal mold 14 is charged with melted metal, a melted metal charge completion signal is inputted from the control console 26 to the controller 40. Further, the charge completion signal can be outputted by detecting a change in pressure of a melted metal injecting plunger or a drop of injection speed of the melted metal, as is well known in the art.

On the other hand, the output circuit 44 is connected to a display unit (e.g., CRT) 47 to display various data representative of progression status of the casting cycle. Further, it is also possible to input various data required to control the squeeze pin 12 through the key board 46 in accordance with instructions displayed on the display unit 47. Further, to the controller 40, the amplifier 35 for the proportional direction flow rate control valve 33 and the amplifier 36 for the proportional relief valve 32 are both connected through signal lines 50 and 51, respectively.

Figure 3:
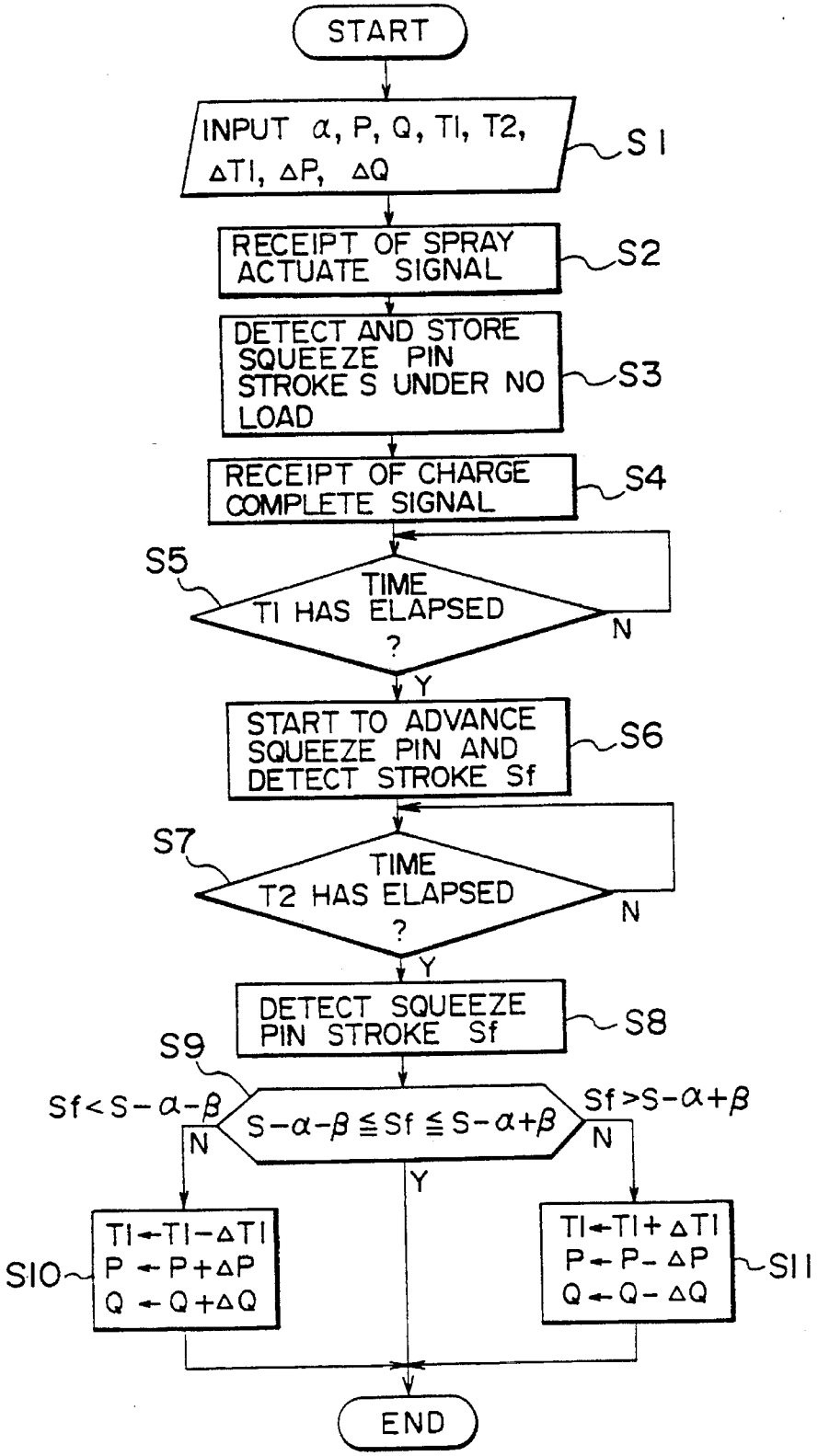
FIG. 3 is a flowchart for assistance in explaining the processing steps of the squeeze pin control apparatus shown in FIG. 1.

With reference to a flowchart shown in FIG. 3, the control procedure of the squeeze pin will be described hereinbelow.

Various data are inputted through the key board 46 as parameters for deciding the optimal stroke of the squeeze pin 10 (in step S1). These parameters are a constant a, a fluid pressure P, a flow rate Q, a waiting time T1, and a pressure application time T2. The constant $\alpha$ is a small value previously determined according to the casting conditions for each squeeze pin. This predetermined small value $\alpha$ is a value indicating a remaining distance (from 2 to 3 mm) within a cavity for pressurization, which is determined irrespective of the diameter of the squeeze pin and the size of the metal mold. The squeeze pin is controllably moved so that the actual stroke value Sf approaches or becomes equal to a set stroke value ($S-\alpha$), where S denotes a full forward stroke under no load, to prevent shrinkage porosities from being produced. The waiting time T1 is a time from when melted metal has been charged completely and to when the squeeze pin starts moving, which is set to such an extent as to be required for solidifying the products. This waiting time T1 exerts an influence upon prevention of shrinkage porosities. Anyway, the respective parameters including the constant a and the waiting time T1 are all initially determined on the basis of the past experience.

With reference to FIG. 2 again, when S denotes a full forward stroke of the squeeze pin 10 which advances to the frontmost end under no load condition, the central processing unit 41 calculates an optimal stroke ($S-\alpha$) of the squeeze pin 10, compares the calculated optimal stroke ($S-\alpha$) with the actually detected stroke, and corrects at least one of the parameters such as pressure P, the flow rate Q and the waiting time T1, etc. so that the actual stoke Sf of the squeeze pin 10 can approach the optimal set stroke ($S-\alpha$) in the succeeding casting cycle.

The pressure P has an influence on cracks in the products, the flow rate Q has an influence on decrease or dissolution of shrinkage porosity apart from a position where the squeeze pin 10 pushes, and the time T has an influence on density of an entire casting.

The pressure P is the working fluid pressure supplied to the squeeze pin cylinder 12, which can be determined by the proportional electromagnetic relief valve 32. The flow rate Q is the quantity of working fluid supplied to the squeeze pin cylinder 12 per unit time, which can be determined by adjusting the opening rate of the proportional electro-magnetic direction flow rate control valve 33. The waiting time T1 is a time required from when melted metal has been charge into the cavity completely to when the squeeze pin 10 starts moving frontward. The pressure application time T2 is a time from when the squeeze pin 10 starts moving to when the stroke of the squeeze pin 10 is detected actually. These waiting time T1 and the pressure application time T2 are both determined according to the casting conditions, and measured (counted) by timer means (not shown) incorporated in the controller 40.

Successively, upon the start of the casting cycle, the metal mold 14 is opened, and a mold releasing agent is sprayed onto the surface of the cavity of the mold 14 by use of a mold lubricant spray (not shown). Simultaneously when the mold releasing agent is sprayed, hydraulic fluid is supplied to the squeeze pin cylinder 12. Further, the actuation command signal of the mold lubricant spray is outputted from the control console 26 of the die casting machine to the controller 40 (in step S2). In response to this spray actuation signal, the central processing unit 41 detects the full forward stroke S of the squeeze pin 10 moving reciprocatingly under no load conditions by the stroke detector 45. On the basis of the output signal of the stroke detector 45, the central processing unit 41 calculates the full forward stroke S of the squeeze pin cylinder 12, and stored the calculated result in the storage device 42 (in step S3).

Then, melted metal is started to be charged into the cavity 13 of the metal mold 14. When the melted metal charge has been completed, a charge completion signal is given from the control console 26 of the die casting machine to the controller 40 (in step S4). Upon the completion of the melted metal charge, the timer (not shown) starts to count time. When the waiting time T1 has elapsed (in step S5), the solenoid 22*a* of the electromagnetic direction control valve 22 is energized, so that hydraulic fluid is supplied into the head side cylinder chamber 12*a* of the squeeze pin cylinder 12.

Figure 4:
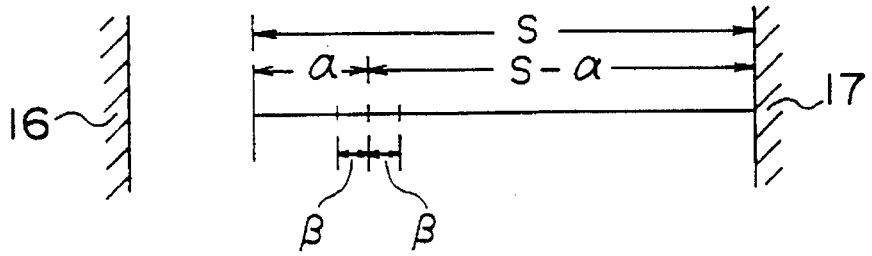
FIG. 4 is a diagram showing a relationship a set stroke and allowable limits.

After that, the squeeze pin 10 starts to advance, so that the melted metal in the cavity starts to be pressurized. At the same time, the stroke of the squeeze pin 10 is started to be detected, and the timer for counting the pressure application time T2 is activated (in step S6). When the time T2 has elapsed after the squeeze pin 10 starts to advance (in step S7), the actual stroke Sf of the squeeze pin 10 is detected by the stroke detector 45, and the detected actual stroke Sf is stored in the storage device 42 (in step S8). The actual stroke Sf of the squeeze pin 10 obtained as described above is compared with the set stroke (S−α) taking allowable deflections ±βinto consideration (in step S9), and the following processing is made according to the comparison result. FIG. 4 shows a relationship between the set stroke (S−α) and the allowable deflections ±β.

If Sf<(S−α−β) (in step S9), an insufficient processing of the squeeze pin 10 is effected (in step S10). In this case, since the squeeze pin 10 does not reach the optimal stroke (S−α) determined under consideration of the casting conditions, the actual stroke must be increased. That is, in order to approach the stroke Sf to the set stroke (S−α) for the succeeding casting cycle, a small value is added to or subtracted from at least one of the parameters, that is, at least one of the working fluid pressure P and the flow rate Q of the squeeze pin cylinder 12, or the waiting time T1 between the melted metal charge completion and the squeeze pin 10 advance, in order that the actual stroke of the squeeze pin 10 can reach the initial set stroke value (S−α). In this case, the pressurizing force applied to the squeeze pin 10 increases with increasing pressure P and flow rate Q, so that the advance speed of the squeeze pin 10 also increases. Therefore, when the stroke is required to be increased, any one of or both of a corrected pressure ΔP and a corrected flow rate ΔQ are added for correction. In contrast with this, the waiting time T1 between the melted metal charge start and the actuation start of the squeeze pin cylinder 12 is reduced or subtracted by a correction time ΔT1 to increase the stroke of the squeeze pin 10. Further, (T1 −ΔT1) is stored in the storage device 42 as a timer setting time. In this case, zero is set to the parameters not corrected (e.g., the correction rates ΔP and ΔQ). Further, the correction rates AT, ΔP and ΔQ are all determined according to the casting conditions on the basis of experience.

As described above, when the pressure P is corrected as P+ΔP, the pressure setting signal corresponding to the correction rate is outputted from the output circuit 44 of the controller 40 to the amplifier 36, to set the pressure of the proportional electromagnetic relief valve 32 to P+ΔP, in the succeeding casting cycle. Further, in the same way, when the flow rate Q is corrected as Q+ΔQ, the opening rate setting signal corresponding to the correction rate is outputted from the output circuit 44 of the controller 40 to the amplifier 35, so that the proportional electromagnetic direction flow rate control valve 33 is controlled to the opening rate proportional to the output of the amplifier 35.

On the other hand, if Sf>(S−α+β) (in step S9), an excessive processing of the squeeze pin 10 is effected (in step 11). In this case, since the squeeze pin 10 advances beyond the optimal stroke (S−α) determined under consideration of the casting conditions, the actual stroke of the squeeze pin 10 must be decreased in the succeeding casting cycle. That is, in contrast with the step S10, the fluid pressure P and the flow rate Q of the squeeze pin cylinder 12 are both decreased by subtracting the correction rate ΔP and ΔQ therefrom, respectively. Further, the waiting time T1 of the squeeze pin 10 is increased by adding the correction rate ΔT1 thereto.

Further, in step S9, when the actually detected stroke Sf has a value within the allowable limits, since the correction is not required, this routine is ended and waits the melted metal charge completion signal for the succeeding casting cycle.

AS described above, in the control method of the present invention, since the stroke of the squeeze pin 10 can be learned and corrected to an optimal value for each casting cycle, it is possible to effectively prevent shrinkage porosities from being produced, with the result that the quality of casted products can be improved.

In the above-mentioned embodiment, although the control of only a single squeeze pin 10 has been explained for brevity. Without being limited to only a single squeeze pin 10, however, the present invention can be of course applied to a die casting machine provided with a plurality of squeeze pins 10. In this case, the squeeze pin cylinders 12 are connected to the hydraulic pressure source circuit 2 via the direction control valves 22, respectively for each squeeze pin 10; hydraulic pipes 54 and 55 arranged on the downstream side of an accumulator 30 are branched for each squeeze pins 10; and a plurality of cylinder control circuits equivalent to the squeeze pin cylinder control circuit 28 are provided for each squeeze pin 10.

In the case of a plurality of squeeze pins, the control processing is basically the same as with the case of a single squeeze pin, and executed in accordance with the flowchart as described above: the stroke of the squeeze pin is detected for each squeeze pin after the melted metal has been charged completely into cavity; each detected stroke value Sf is compared with each set stroke (S−α); and one of or combination of various parameters (such as the pressure P or flow rate Q of hydraulic fluid supplied to each squeeze pin cylinder 22, and the waiting time T1 between the melted metal charge completion and the squeeze pin actuation) is corrected on the basis of the comparison result, so that each stroke of the squeeze pin can be adjusted automatically to the each optimal stroke.

Another embodiment of the present invention will be described hereinbelow with reference to FIG. 5.

Figure 5:
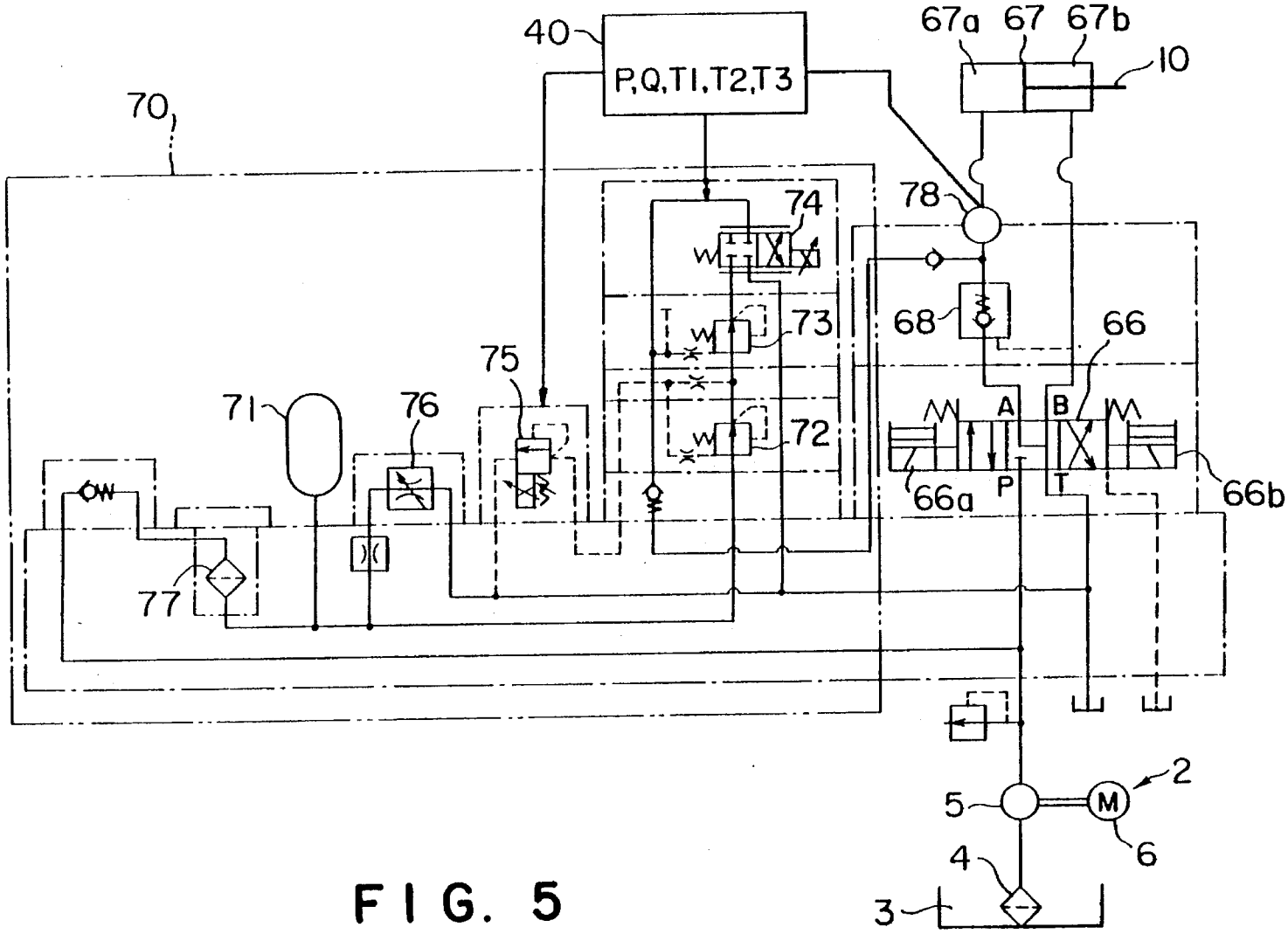
FIG. 5 is a diagram showing a hydraulic circuit used for embodying the squeeze pin control apparatus according to the present invention.

FIG. 5 shows a hydraulic circuit for controlling the squeeze pin 10. In FIG. 5, a hydraulic pressure source circuit 2 is used in common with the hydraulic circuit for a core cylinder of a die casting machine, in the same way as with the case of the afore-mentioned embodiment. The hydraulic pressure source circuit 2 is provided with an oil pump 5 driven by a motor 6. The hydraulic fluid (oil) sucked from a tank 3 through a filter 4 is pressurized by the hydraulic pump 5, and then supplied to a squeeze pin cylinder 67 for driving the squeeze pin 10 through an electromagnetic direction control valve 66 of 4-port and 3-position type.

In this embodiment, when the electromagnetic direction control valve 66 is switched in such a way that a port P and a port A communicate with each other by energizing a solenoid 66*a*, since the hydraulic fluid is supplied to an end-side cylinder chamber 67*a* of the squeeze pin cylinder 67 through a pilot check value 68, the squeeze pin 10 advances into the melted metal. On the other hand, when the port P communicate with a port B by energizing a solenoid 66*b*the squeeze pin 10 returns to its original position. Further, since the hydraulic fluid returned from the head-side cylinder chamber 67*b* of the squeeze pin cylinder 67*b* is introduced into the pilot check valve 68 as a pilot pressure, when the load applied to the squeeze pin increases beyond a predetermined value, this pilot check valve 68 is opened to release the hydraulic fluid into the tank 3. The electromagnetic direction control valve 66 is mainly used to control the operation of the squeeze pin cylinder 67, in particular when the squeeze pin 10 is moved under no-load condition for initial adjustment.

On the other hand, when the melted metal prior to solidification is pressurized locally by use of the squeeze pin 10, the pressure and the flow rate of the hydraulic fluid supplied to the squeeze pin cylinder 67 is controlled by a squeeze pin hydraulic circuit 70.

This squeeze pin hydraulic circuit 70 is composed of an accumulator 71 for accumulating the hydraulic fluid supplied by the hydraulic pump 5, a pressure reducing valve 72, a pressure compensating valve 73, a proportional electromagnetic direction flow rate control valve 74, a proportional electromagnetic relief valve 75, an escape valve 76, etc. To the accumulator 71, the hydraulic fluid is supplied from the hydraulic pump 5 through the filter 77. The pressure of the hydraulic fluid pressurized to a predetermined pressure by this accumulator 71 is further adjusted to another predetermined pressure by the pressure reduction valve 72 on the outlet side thereof. In addition, the fluctuations of the hydraulic pressure due to load fluctuations of the squeeze pin 10 is compensated for by the proportional electromagnetic relief value 73. The compensated hydraulic fluid is supplied to the end-side cylinder chamber **67*a* of the squeeze pin cylinder 67, when the proportional electromagnetic direction flow rate control valve 74** is energized.

In the same way as with the case of the afore-mentioned embodiment, the set pressure of the hydraulic fluid to be supplied to the squeeze pin cylinder 67 is adjusted by the proportional electromagnetic relief valve 75, and the flow rate of the hydraulic fluid is controlled by the proportional electromagnetic direction flow rate control valve 74, respectively.

In this embodiment, a flow rate counter 78 is provided in particular to count the flow rate of the hydraulic fluid supplied to the squeeze pin cylinder 67 in a predetermined unit, when the solenoid of the proportional electromagnetic direction flow rate control valve 74 is energized. In this embodiment, since the stroke of the squeeze pin 10 is proportional to the flow rate of the hydraulic fluid, it is possible to obtain the fluid flow rate by measuring the position of the squeeze pin 10 indirectly on the basis of the above-mentioned relationship between both.

What is claimed is:

1. A method of controlling a squeeze pin in a die casting machine for locally pressurizing melted metal charged into a cavity of a metal mold with at least one squeeze pin, comprising the steps of:

detecting a stroke S of the squeeze pin under no load condition of a squeeze pin cylinder for driving the squeeze pin;

setting a value (S–α) obtained by subtracting a small value α from the detected squeeze pin stroke S as a set stroke of the squeeze pin;

advancing the squeeze pin after a predetermined waiting time has been elapsed from when melted metal has been charged into the cavity completely;

detecting an actual stroke of the squeeze pin;

comparing a detected actual stroke value Sf with set limits (S–α±β, where β is an allowable deflection); and if the comparison result is that Sf oversteps the set limits (S–α±β), correcting at least one of parameters of pressure and flow rate of hydraulic fluid supplied to the squeeze pin cylinder and the waiting time so that the detected stroke value Sf approaches the set stroke (S–α) in the succeeding casting cycle.

2. The method of controlling a squeeze pin of claim 1, wherein the actual stroke Sf of the squeeze pin is detected after a predetermined pressure application time has elapsed from when the squeeze pin starts to advance.

3. The method of controlling a squeeze pin of claim 1, wherein the small value is 2 to 3 mm.

4. An apparatus for controlling a squeeze pin in a die casting machine for locally pressurizing melted metal charged into a cavity of a metal mold with at least one squeeze pin, comprising:

stroke detecting means for detecting an actual stroke S of the squeeze pin;

squeeze pin cylinder control means for controlling pressure and flow rate of hydraulic fluid supplied to a squeeze pin cylinder for driving the squeeze pin;

stroke correcting means for comparing a detected stroke value Sf of the squeeze pin after a predetermined time has elapsed from when the squeeze pin starts to be advanced by the squeeze pin cylinder, with a set stroke (S–α) obtained by subtracting a small value α from a full stroke S of the squeeze pin under no load of the squeeze pin cylinder; and if Sf oversteps set limits (S –α±β, where β is an allowable deflection), correcting pressure and/or flow rate of hydraulic fluid supplied to the squeeze pin cylinder and waiting time so that the detected stroke value Sf approaches the set stroke (S–α) in the succeeding casting cycle; and control means for controlling the squeeze pin cylinder control means on the basis of the corrected result of said stroke correcting means.

5. The apparatus for controlling a squeeze pin of claim 4, wherein a plurality of squeeze pins are provided; a plurality of squeeze pin cylinders are provided for the squeeze pins, individually; and a plurality of squeeze pin cylinder control means are provided for the squeeze pin cylinders, respectively.

6. The apparatus for controlling a squeeze pin of claim 4, wherein said squeeze pin cylinder control means comprises an accumulator for accumulating the hydraulic fluid, whereby the pressure of the hydraulic fluid being supplied to the squeeze pin cylinder is adjusted by a proportional electromagnetic relief valve, and the flow rate of the hydraulic fluid is controlled by a proportional electromagnetic direction flow rate control valve.

7. The apparatus for controlling a squeeze pin of claim 4, wherein said control means is of a digital type.

8. A die casting machine for reducing or eliminating shrinkage porosities by pushing a squeeze pin into melted metal prior to solidification by use of a hydraulic cylinder during die casting by use of a metallic mold, which comprises:

a hydraulic fluid supply source:

a pressure adjusting section for adjusting pressure of hydraulic fluid supplied by said hydraulic fluid supply source;

a pressure compensating section for compensating for pressure of the hydraulic fluid whose pressure is adjusted by said pressure adjusting section;

a flow rate adjusting section for adjusting flow rate of the hydraulic fluid whose pressure is adjusted by said pressure compensating section;

a direction switching valve for switching direction of the hydraulic fluid whose flow rate is adjusted by said flow rate adjusting section;

a hydraulic cylinder connected to said direction switching valve to move the squeeze pin; and a control section for previously obtaining corresponding relationship between flow rate of the hydraulic fluid passed through said direction switching valve and position of the squeeze pin and measuring the squeeze pin position indirectly on the basis of the obtained corresponding relationship between both, to control operation stroke and operation time of the hydraulic cylinder and the squeeze pin position indirectly.

9. The die casting machine for reducing or eliminating shrinkage porosities of claim 8, further comprising a flow rate counter for counting flow rate of the hydraulic fluid passed through said direction switching valve.

* * * * *